United States Patent [19]

DePrima

[11] Patent Number: 4,854,078

[45] Date of Patent: Aug. 8, 1989

[54] CURVED SLIDING DOOR ASSEMBLY AND METHOD OF REPAIR

[75] Inventor: George R. DePrima, Libertyville, Ill.

[73] Assignee: Morton Manufacturing Co., Libertyville, Ill.

[21] Appl. No.: 306,689

[22] Filed: Feb. 6, 1989

[51] Int. Cl.[4] ..... E05D 15/06

[52] U.S. Cl. ..... 49/409; 16/87 R

[58] Field of Search ..... 49/409, 412, 231; 160/196 R, 330; 16/86.1, 86.2, 87, 88, 91, 93 R, 90

[56] References Cited

U.S. PATENT DOCUMENTS

| | | | |
|---|---|---|---|
| 2,963,753 | 12/1960 | Seaburg | 49/409 |
| 3,089,203 | 5/1963 | Roselius | 49/409 |
| 3,466,698 | 9/1969 | Nystrom | 49/409 |
| 3,740,898 | 6/1973 | McKenzie | 16/87 |

*Primary Examiner*—Kenneth J. Dorner
*Assistant Examiner*—Gerald Anderson
*Attorney, Agent, or Firm*—Tilton, Fallon, Lungmus & Chestnut

[57] ABSTRACT

A curved sliding door assembly for a transit vehicle such as a subway car which is particularly useful in retrofitting many cars having prior art hanger assemblies which employ a split tube having three circumferentially spaced raceways therein and which was subject to "chattering", the improved hanger assembly including a pair of opposed ball bearing raceways slidably supporting a horizontally elongated hanger member equipped with end bores for the receipt of pivot pins, the pivot pins being carried by a hanger bar slidably inserted into the prior art door.

5 Claims, 1 Drawing Sheet

CURVED SLIDING DOOR ASSEMBLY AND METHOD OF REPAIR

BACKGROUND AND SUMMARY OF INVENTION

This invention relates to a curved sliding door assembly and method of repair and, more particularly, to an improved application of a portion of the construction described in co-owned U.S. Pat. No. 3,740,898.

In the '898 patent, it was pointed out that various transit authorities had turned to hanger assemblies for curved sliding doors which employed circular raceways with a plurality of ball bearings about the circular inner periphery to provide the desired sliding, pivoting action. The pivoting action was required because the center of gravity of the curved door was no longer directly below the sliding support.

According to the present invention, the sliding, pivoting features of the '898 patent are employed in conjunction with the door attaching means of the prior art which had used the circular raceways. This has not only resulted in the ability to quickly retrofit the door assemblies of the prior art but provide advantages thereover.

An important feature of the invention is the provision of a new hanger bar which permits the retrofitting without welding or other time consuming operations. Other objects and advantages of the invention may be seen in the ensuing specification.

The invention is explained in conjunction with the accompanying drawing, in which FIG. 1 is a fragmentary end elevational view of the prior art door as featuring the circular raceway;

DETAILED DESCRIPTION

Figure 1:
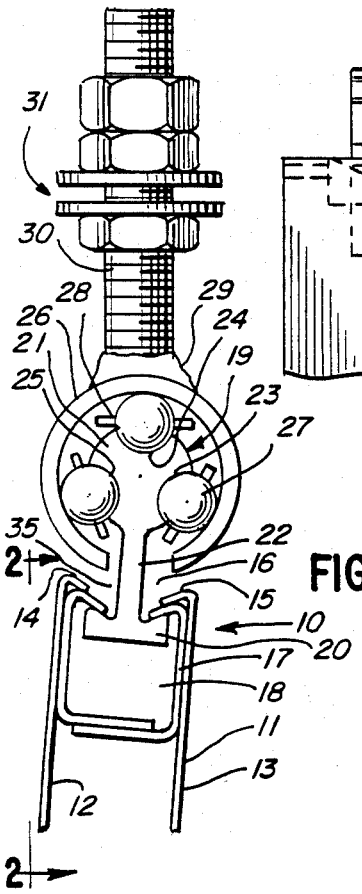
Figure 2:
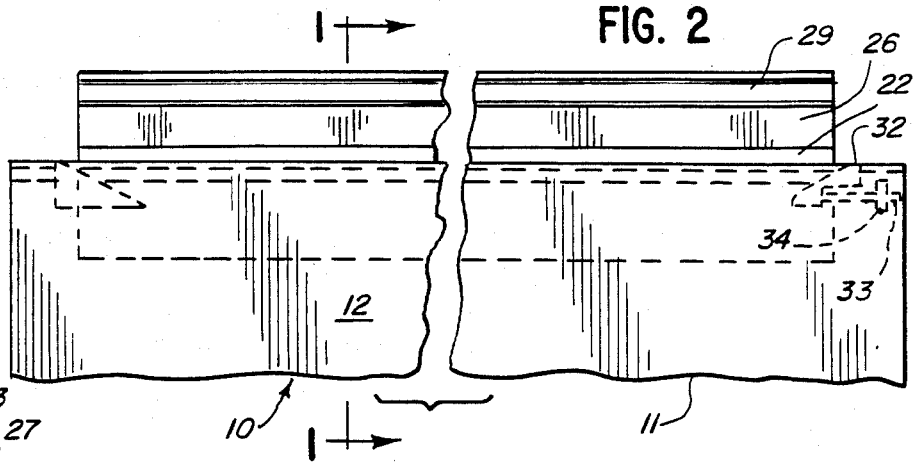
FIG. 2 is a fragmentary side elevational view of the prior art door assembly of FIG. 1.

In the illustration given and with reference first to FIGS. 1 and 2, a prior art door assembly generally designated 10 is depicted. This includes a door 11 which includes spaced apart vertically extending sidewalls 12 and 13 which are disposed at an angle to the vertical, thereby denoting the curvature of the door. For further details of the door environment, reference may be made to the above identified '898 patent disclosure.

Adjacent their upper ends, each of the sidewalls 12 and 13 are equipped with an integral, reverse angle flange as at 14 and 15 respectively. In other words, the flanges 14 and 15 extend downwardly and interiorly. The flanges 14 and 15, as clearly seen in FIG. 1 terminate a spaced distance from each other as at 16. Advantageously, a horizontally extending stiffener 17 may be provided which conforms to the angularity of the flanges 14 and 15 as well as the sidewalls 12 and 13. In any event, a slot 18 of generally T-shaped cross section is provided which heretofore had received a hanger beam generally designated 19.

More particularly the hanger beam 19 could be considered as having a generally I cross section featuring a lower enlargement 20 and an upper enlargement 21 connected by an intermediate web 22. The elements 20–22 were all unitary and relatively horizontally elongated as can be appreciated from the upper part of FIG. 2.

The upper enlargement 21 of the hanger beam 19 was generally circular in cross section and grooved to provide three raceway portions as at 23, 24 and 25. Additionally, the upper enlargement 21 was housed within a split tube 26 which also provided raceway portions so as to confine the ball bearings 27 (only one of which is so designated). Further, the ball bearings 27 were retained in place in the raceways defined by the grooves 23–25 and the interior of the split ring 26 by clips as at 28. Again, as can be appreciated from a consideration of FIG. 2, the split tube 26 was relatively horizontally elongated and equipped with an integral top structure 29 which provided a means for connecting the securing screws 30 for attaching the hanger assembly to the chassis of the transit authority vehicle.

The hanger assembly of FIGS. 1 and 2 is generally designated 31 and includes the hanger beam 19, the split tube 26 and the superstructure 29 along with the bolts 30.

To install the door of the prior art, a wedge lock 32 (see the right hand portion of FIG. 2) was removed by backing off a stud 33 mounted in a bracket 34. This then permitted the door 11 to be slid horizontally off of the lower enlargement 20 of the hanger beam 19.

The hanger assembly 31 of the prior art suffered from a significant defect in that the provision of the pivoting and sliding features in the same area caused "chattering" of the ball bearings 27 within the split tube 26 so that as time passed, the mounting deteriorated and required frequent replacement. This was onerous because the portion of the door assembly to be replaced was the means for mounting the door itself. Inasmuch as door mountings deteriorated at different rates, this meant frequent down-time and loss of service of the subway cars, etc.

I have discovered that the design flaw in the prior art mounting resides primarily in the hanger assembly 31 wherein there is an extraordinary spacing between the upper and lower enlargements 21 and 20, respectively while using the upper enlargement 21 as both the pivoting and sliding means. In particular, there is a sizeable height in the web 22 which extends through the slit 35 in the split tube 26. I had known from the long and successful service of the '898 hanger assembly that it was not subject to the disadvantages of the hanger assembly 31 of the prior art and have, as a consequence, provided an improved modification of the '898 hanger assembly which features a novel hanger bar generally designated 101 (see FIGS. 3 and 4).

The Inventive Arrangement

Figure 3:
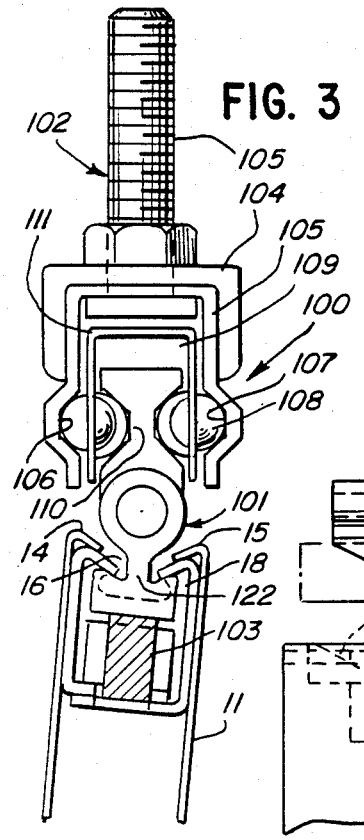
FIG. 3 is a fragmentary end elevational view of the inventive door assembly and which features in part a hanger assembly of the '898 patent and the novel hanger bar previously referred to; an FIG. 4 is a fragmentary, exploded side elevational view of the inventive door assembly of FIG. 3.
Figure 4:
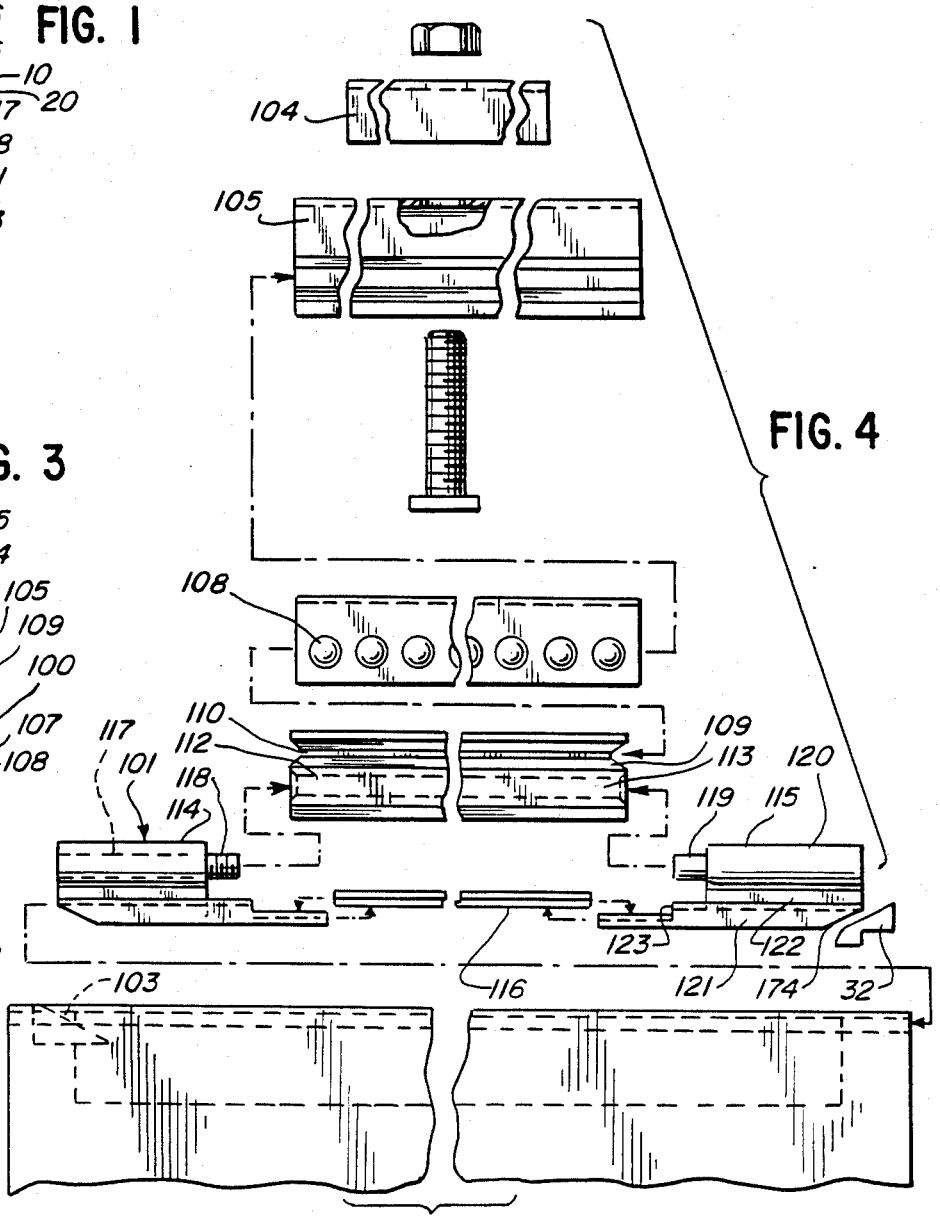

In considering the structure illustrated in FIGS. 3 and 4, it will be appreciated that the upper portion of the door assembly is like that of the '898 patent while the lower portion is like that of the prior art door. To assist in recognizing what features of the inventive door assembly are new over the prior art arrangement depicted in FIGS. 1 and 2, I have employed numerals in the 100 et seq. sequence. Thus, the overall door assembly is generally designated 100 and includes the previously referred to hanger bar 101 between the door 11 and a second hanger assembly generally designated 102. It will be appreciated that the door 11 of FIG. 3 is identical to that of FIG. 1, the only difference being the showing of the end retainer 103 which was omitted from FIG. 1 for the sake of clarity. However, this retainer is also pictured at the extreme right of FIG. 2. However, the upper edge of the door is the same having the downwardly, interiorly extending flanges 14 and 15 which define a generally T-shaped slot 18.

Now referring to the upper portion of FIG. 3, the second hanger assembly 102 includes a bracket 104 which is secured by suitable bolts or studs 105 to the chassis of the car. Mounted within the bracket 104 and an integral part thereof is a downwardly facing channel 105. The channel 105 is horizontally elongated and is equipped with raceway portions 106 and 107 which serve to partially confine and support ball bearings 108 (only one of which is so designated).

Positioned within the channel 105 and between the ball bearings 108 is a hanger member 109. Along its vertical sides, the hanger member 109 is equipped with grooves or raceway defining portions 110 (only one of which is designated). The grooves 110 cooperate with the raceway portions 106, 107 to confine the ball bearings 108. Thus, the hanger member 109 is slidably supported for horizontal movement on the ball bearings 108. As also described in the '898 patent, a closure member 111 is provided at the ends of the raceways to confine the ball bearings 108 against inadvertent displacement.

Reference is now made to FIG. 4 where the hanger bar 109 is depicted in side elevational and each end thereof is equipped with a horizontal bore at 112 and 113.

The bores 112 and 113 provide for an advantageous connection of the novel hanger bar 101 previously referred to. Now referring to FIG. 4, it will be seen that in the illustrated embodiment, the hanger bar 101 includes a pair of pivot block elements 114 and 115 connected by a bar portion 116. For ease of manufacturing, I cast the pivot block elements 114 and 115 and weldably secure thereto the bar portion 116. The left pivot block element 114 is seen to be equipped with a threaded bore as at 117 for the receipt of a stud 118. By backing off the stud 118, the pivot pin 119 of the pivot block 115 can be inserted into the bore 113 after which the stud 118 is again extended to be received within the bore 112. This then attaches the hanger bar 101 to the hanger member 109.

Each of the pivot blocks 114, 115 includes a generally cylindrical portion 120 equipped with a bore such as at 117 relative to the pivot block 114 and also has an integrally connected, axially extending slide portion 121 connected to the cylindrical portion 120 by an integral web 122. The web has a thickness less than the spaced distance 16 provided as part of the slot 18 (see FIG. 3).

Each slide portion 121 adjacent the inner end thereof projects inwardly beyond the associated cylindrical portion and has a transverse step as at 123 for the weldable securement of the bar portion 116. Each of the slide portions 121 has a beveled end as at 124 so as to be confined by the stationary stop 103 at the left and the removable lock 32 at the right. Also, as before, the areas of the bar portion 116 confronting the flanges 14,15 are chamfered.

Operation

In the operation of the invention to retrofit a prior art door assembly, I start with the door assembly of the prior art as seen in FIG. 1 which includes a door 11 having inner and outer walls 13 and 12, respectively. The door along its upper edge is equipped with a horizontally elongated slot 18 defined by the inner and outer walls 13, 12 which, adjacent their upper ends, have integral downwardly and interiorly extending flanges 15, 14 terminating a spaced distance from each other as at 16. This provides a generally T-shape in cross section to the slot 18. Initially, this slot had received a horizontally elongated hanger beam 19. Normally the slot 18 was open at at least one horizontal end thereof as seen at the right in FIG. 2. From that end, the wedge-ended hanger beam 19 was slidably mounted in the slot 18 from the right hand end. The hanger beam 19 had upper and lower transverse enlargements 21, 20 to provide a generally I-shape in cross section. The lower enlargement 20 had chamfered upper longitudinal side portions confronting the flanges 14, 15 and the prior art provided releasable wedge lock means in the form of the element 32 to confine the hanger beam 19 in the slot 18. The upper enlargement 21 had three longitudinally extending circumferentially spaced apart raceway portions 23–25 with the door assembly also including a first hanger assembly boldably secured to the chassis of the car. The hanger assembly 31 included a horizontally elongated split tube 26 having a lower facing slit 35 for the receipt of the hanger beam 19. The tube 26 interior provided a complementary raceway portion to confine the ball bearings 27.

To retrofit the prior art door assembly with my improved hanger assembly, I first remove the wedge lock means 32 and thereafter slidably remove the door 11 from the lower enlargement 20 of the hanger beam 19. Thereafter I unbolt the first hanger assembly 31 from the chassis of the car and bolt the second hanger assembly 102 to the chassis.

This second hanger assembly 102 includes a channel 105 equipped with raceway portions 106 and 107 and a horizontally elongated hanger member 109 equipped with complementary raceway portions 110 for the confinement of ball bearings 108. The hanger member 109 has bores 112, 113 in the ends thereof and I achieve the final mounting of the door in either one of two ways, depending upon the preference of the retrofitter.

I can either install the hanger bar 101 in the hanger member 109 and thereafter slide the door onto the hanger bar 101 or I can slide the hanger bar 109 into the slot 118 first, lock the same in place with the wedge lock means 32 and thereafter install the door which is now equipped with the hanger bar on the hanger member 109. This is done, as indicated previously, by backing off the stud 118 and inserting the pivot pin 119 into the bore 113 and thereafter reextending the stud 118 into the bore 112. In either event, however, an advantageous new mounting is provided with a minimum of effort—no welding or other time consuming labor being required—and one which brings the advantageous balanced sliding feature of the '898 patent to the prior art door assembly. In addition, the weight of the door is quite close to the pivot axis so that the elongated moment arm of the prior art hanger beam is avoided.

While in the foregoing specification a detailed description of the invention has been set down for the purpose of illustration, many variations in the details herein given may be made by those skilled in the art without departing from the spirit and scope of the invention.

I claim:

1. A curved sliding door assembly for a rail passenger car comprising a car frame, a vertically elongated generally rectangular door having a vertical curvature mounted in said frame for a horizontal sliding movement, said door along its upper edge being equipped with a horizontally elongated slot defined by inner and outer walls of said door with integral downwardly and interiorly extending flanges terminating a spaced distance from each other to provide a generally T-shape to said slot in cross-section adapted to receive a horizontally elongated hanger bar, said slot being open at least at one horizontal end thereof, a wedge-ended, T-shaped hanger bar slidably mounted in said slot and inserted therein from said one end, said hanger bar having chamfered upper longitudinal side portions confronting said flanges, releasable wedge lock means in said slot adjacent said one end closing said slot and confining said hanger bar in said slot, said hanger bar being equipped with a pair of integral, horizontally spaced apart pivot blocks, said pivot blocks projecting upwardly beyond said door upper edge, each pivot block being equipped with horizontal bore, a pivot pin mounted in each pivot block bore and projecting horizontally outwardly of said pivot block toward the other pivot pin, a hanger assembly mounted on said frame above said door and equipped with a pair of horizontally opposed raceway portions for ball bearings, a horizontally elongated hanger member positioned in said hanger assembly and equipped with longitudinally extending raceway portions on opposite vertical sides thereof arranged to cooperate with the hanger assembly raceway portions in defining a pair of raceways, a plurality of ball bearings in said pair of raceways for supporting said hanger member for horizontal movement relative to said hanger assembly, said hanger member extending substantially between said pivot block and at each end being equipped with a bore for the receipt of a projecting part of the pivot pin of each pivot block whereby said pivot blocks are adapted to pivot about a horizontal axis defined by said pivot pins below said pair of raceways, one of said block bores extending horizontally through the block whereby the pivot pin in said one bore is axially movable to disengage said door from said hanger member alternative to removing said wedge lock means for disengaging said door from hanger bar.

2. The structure of claim 1 in which said hanger bar includes a pair of spaced apart, cast pivot block elements each including a generally cylindrical portion equipped with said bore and an axially extending integral slide portion connected to said cylindrical portion by an integral web, said web having a thickness less than said spaced distance between said wall flanges, said web and slide portion of the pivot block element adjacent said one end having a beveled outer end confronting said wedge lock means, each said slide portions adjacent the inner ends thereof projecting inwardly beyond the associated cylindrical portions and having a transverse step therein, and a bar portion weldably secured to each projecting slide portions to maintain the same in horizontally spaced relation adjacent the ends of said slot.

3. A method of repairing the curved door assembly of a rail transit vehicle chassis wherein said door assembly includes a door having inner and outer walls, said door along its upper edge being equipped with a horizontally elongated slot defined by said inner and outer walls, said walls adjacent their upper ends having integral downwardly and interiorly extending flanges terminating a spaced distance from each other to provide a generally T-shape to said slot in cross-section adapted to receive a horizontally elongated hanger beam, said slot being open at least at one horizontal end thereof, a wedge-ended hanger beam slidably mounted in said slot and inserted therein from said one end, said hanger beam having upper and lower transverse enlargements to provide a generally I shape in cross section, the lower of said enlargements having chamfered upper longitudinal side portions confronting said flanges, releasable wedge lock means in said slot confining said hanger beam in said slot, said upper enlargement having three longitudinally extending circumferentially spaced apart raceway portions, said door assembly also including a first hanger assembly boltably secured to said chassis, said hanger assembly including a horizontally elongated split tube having a lower facing slit for receipt of said hanger beam, said tube providing a raceway portion, and a plurality of ball bearings between the raceway portions of said upper enlargement and said tube, said method comprising:

removing said wedge lock means and slidably removing said door from said hanger beam lower enlargement, unbolting said first hanger assembly from said chassis, bolting a second hanger assembly to said chassis, said second hanger assembly being equipped with a pair of horizontally opposed raceway portions for ball bearings, a horizontally elongated hanger member positioned in said second hanger assembly and equipped with longitudinally extending raceway portions on opposite vertical sides thereof arranged to cooperate with the second hanger assembly raceway portions in defining a pair of raceways, a plurality of ball bearings in said raceways for supporting said hanger member for horizontal movement relative to said hanger assembly, said hanger member being horizontally elongated and having a horizontally extending bore in each end, and mounting said door on said hanger member, said door including a horizontally elongated hanger bar mounted in said slot and equipped adjacent the ends thereof with a pair of integral pivot blocks, each pivot block having an inwardly extending pin for receipt in a bore of hanger member.

4. The method of claim 3 which includes the steps of inserting said hanger bar in said slot, releasably locking said hanger bar in said slot with wedge lock means, one of said pivot block pins being retractable, retracting said one pivot block pin, aligning said pivot block pins with the bore of said hanger bores and extending said one pivot block pin into its aligned hanger member bore.

5. The method of claim 3 which includes the steps of first inserting said hanger bar pivot pins into the bores of said hanger member, thereafter inserting said hanger bar into said door slot and releasably locking said hanger bar in said slot.

* * * * *